US006453144B1

(12) United States Patent
Sato

(10) Patent No.: US 6,453,144 B1
(45) Date of Patent: Sep. 17, 2002

(54) IMAGE HEATING APPARATUS FOR HEATING IMAGE FORMED ON RECORDING MATERIAL

(75) Inventor: Takashi Sato, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/945,731

(22) Filed: Sep. 5, 2001

(30) Foreign Application Priority Data

Sep. 8, 2000 (JP) ..... 2000-273337

(51) Int. Cl.[7] ..... G03G 15/20

(52) U.S. Cl. ..... 399/328; 219/216; 219/619; 399/45; 399/330

(58) Field of Search ..... 219/216, 619; 399/45, 67, 320, 328, 330, 334, 335

(56) References Cited

U.S. PATENT DOCUMENTS 4,274,624 A 6/1981 Sato et al. ..... 271/292
5,881,349 A * 3/1999 Nanataki et al. ..... 399/328
6,049,691 A * 4/2000 Abe et al. ..... 399/330
6,246,843 B1 6/2001 Nanataki et al. ..... 399/45

FOREIGN PATENT DOCUMENTS

| | | |
|---|---|---|
| JP | 4-166966 | 6/1992 |
| JP | 5-9027 | 2/1993 |
| JP | 9-171889 | 6/1997 |

* cited by examiner

*Primary Examiner*—Arthur T. Grimley
*Assistant Examiner*—Hoang Ngo
(74) *Attorney, Agent, or Firm*—Fitzpatrick, Cella, Harper & Scinto

(57) ABSTRACT

An image heating apparatus for heating an image formed on a recording material includes a heating member, an excitation coil for generating a magnetic flux to induce an eddy current in the heating member, and a magnetic flux shield member coupled to the heating member for making the magnetic flux small. The magnetic flux shield width of the magnetic flux shield member in the longitudinal direction of the heating member differs in a direction intersecting with the longitudinal direction, and the magnetic flux shield member is movable in the direction intersecting with the longitudinal direction.

8 Claims, 6 Drawing Sheets

IMAGE HEATING APPARATUS FOR HEATING IMAGE FORMED ON RECORDING MATERIAL

BACKGROUND OF THE INVENTION

1. Field of the Invention

This invention relates to an image heating apparatus of the induction heating type for heating an image formed on a recording material.

2. Related Background Art

Various image heating apparatuses using the principle of electromagnetic induction have in recent years been proposed as an image heating apparatus like the fixing device of an image forming apparatus such as a printer or a copier.

An apparatus of this type is one which uses an electromagnetic induction heat generating body as a heating body and in which a magnetic field is made to act on this electromagnetic induction heat generating body by magnetic field generating means and heat is imparted to a material to be heated by Joule heat generation based on an eddy current produced in the electromagnetic induction heat generating body to thereby heat and fix an unfixed toner image on the surface of the material to be heated.

Japanese Patent Publication No. 5-9027 discloses an apparatus of the heating roller type in which a metallic fixing roller of a ferromagnetic material is electromagnetically induction heated., and this apparatus can make a heat generating position near to a pressure contact nip portion, and achieves a fixing process higher in efficiency than an apparatus of the heating roller type using a halogen lamp as a heat source. However, the heat capacity of the metallic fixing roller is great, and this has led to the problem that to make the temperature of the pressure contact nip portion rise by limited electric power, great electric power is required.

Japanese Patent Application Laid-Open No. 4-166966 discloses a fixing apparatus of the electromagnetic induction heating type using a film-like metallic fixing roller reduced in heat capacity. However, in the film-like metallic fixing roller reduced in heat capacity, the heat transfer in the lengthwise direction thereof (the longitudinal direction of the pressure contact nip portion) is hampered and therefore, there has arisen the problem that when paper of a small size is fed, an excessive temperature rise in a non-feeding portion.(non-feeding portion temperature rise) occurs to thereby reduce the life of the film or a pressure roller.

Actually the outer peripheral surface of the metallic fixing roller is heated until the temperature thereof becomes a temperature (e.g. 150° C. to 200° C.) suited for fixing, and the temperature of the interior of the metallic fixing roller also rises to the same temperature as that of the outer peripheral surface of the metallic fixing roller. Further, the heat generation by copper loss occurring due to an electric current flowing to a coil itself and the heat generation by the iron loss of a core are added, and the interior of the metallic fixing roller more excessively rises in temperature than the outer peripheral surface of the metallic fixing roller. Furthermore, in the non-feeding region, the material to be heated which takes the amount of heat of the outer peripheral surface of the metallic fixing roller does not pass and therefore, the outer peripheral surface of the metallic fixing roller in the non-feeding region rises to a temperature above the temperature suited for fixing, and the temperature of an excitation coil therein further rises and partly assumes an excessively heat rising state. In the narrow space in the fixing roller, sufficient radiation cannot take place and thus, a highly heat-resistant number is used as the coil itself, and this becomes a factor of an increased cost.

As a countermeasure for such excessive temperature rise of the non-feeding region, it is described in Japanese Patent Application Laid-Open No. 9-171889 that a magnetic flux shield plate rotatable in conformity with the size of a recording material is provided in cylindrical heat generating film.

Also, in U.S. Pat. No. 6,246,843, there is described a construction in which discretely from an excitation coil, a second coil for decreasing a magnetic flux is provided and a circuit having a second coil is opened or closed in conformity with the size of a recording material.

The present invention provides an image heating apparatus of the induction heating type which can change a heat generating area by a construction simpler than these propositions and in accordance with recording materials of various sizes.

SUMMARY OF THE INVENTION

The present invention has been made in view of the above-noted problem and an object thereof is to provide an image heating apparatus which can effect heat generation conforming to the size of a recording material.

Another object of the present invention is to provide an image heating apparatus which can effect heat generation conforming to the size of a recording material by a simple construction.

Still another object of. the present invention is to provide an image heating apparatus comprising:

- a heating member;
- an excitation coil for generating a magnetic flux to induce an eddy current in the heating member; and
- a magnetic flux shield member coupled to the heating member for making the magnetic flux small;
- wherein the magnetic flux shield width of the magnetic flux shield member in the longitudinal direction of the heating member differs in a direction intersecting with the longitudinal direction, and the magnetic flux shield member is movable in the direction intersecting with the longitudinal direction.

Further objects of the present invention will become apparent from the following detailed description when read with reference to the accompanying drawings.

DESCRIPTION OF THE PREFERRED EMBODIMENTS

Some embodiments of the present invention will hereinafter be described with reference to the drawings.

Figure 1:
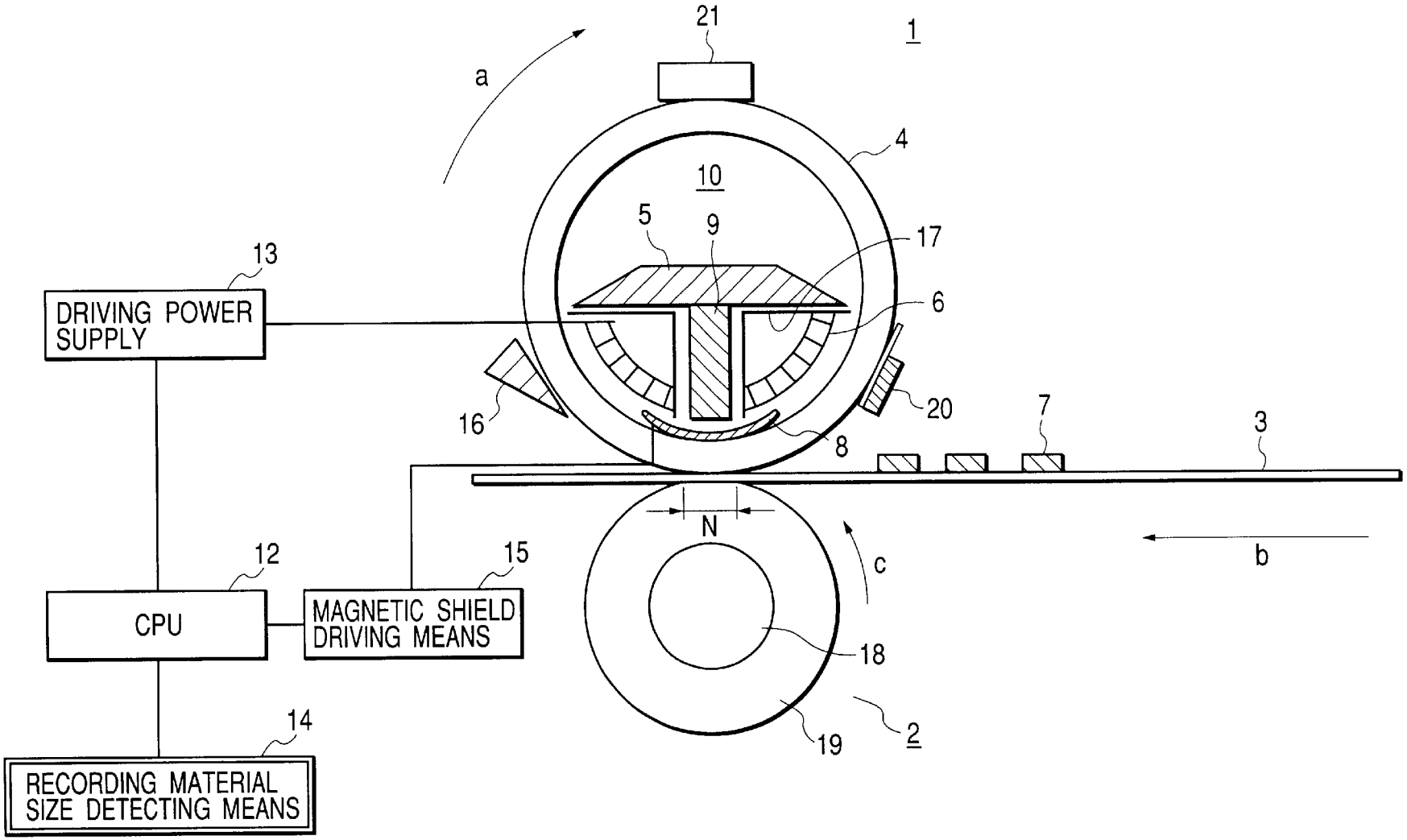
FIG. 1 is a transverse cross-sectional view schematically showing a heating apparatus according to Embodiment 1 as it is applied to a fixing apparatus.
Figure 2:
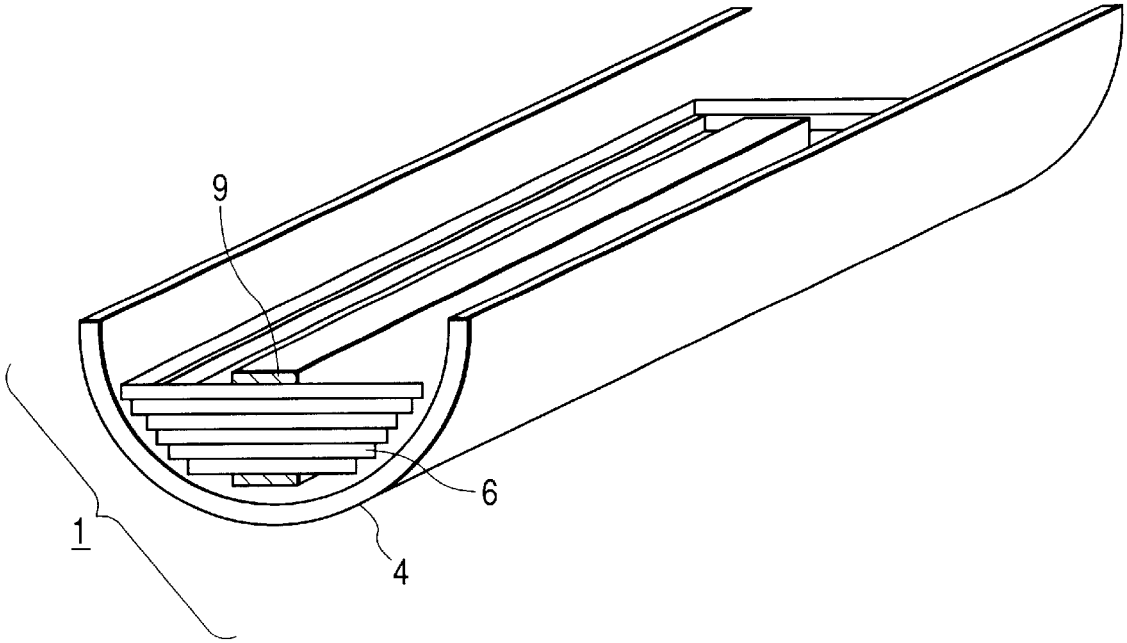
FIG. 2 is a cut-away perspective view of a portion of a metallic fixing roller in the fixing apparatus.

FIG. 1 is a transverse cross-sectional view schematically showing a fixing apparatus of the induction heating type according to an embodiment of the present invention, and FIG. 2 is a cut-away perspective view of a portion of a metallic fixing roller in the fixing apparatus. The fixing apparatus shown in FIGS. 1 and 2 serves to melt an unfixed toner image 7 formed on a recording material 3 being conveyed by heat and fuse it onto the recording material 3. A heating assembly 1 has a coil assembly 10 for generating a high frequency magnetic field, a metallic fixing roller 4 (corresponding to a heating medium) heated by the coil assembly 10 and provided for movement along the conveyance direction of the recording material 3, a stay 11 (corresponding to an insulating member) fixed to a fixing unit frame, not shown, to maintain a uniform gap between the metallic fixing roller 4 and the coil assembly 10, and a pressure roller 2 opposed to the metallic fixing roller 4 with the conveying path of the recording material 3 interposed therebetween and brought into pressure contact therewith.

The metallic fixing roller 4 is provided for rotation in the direction of arrow a in FIG. 1 and is rotatively driven by a drive source such as a motor, not shown. The pressure roller 2 is rotated in the direction of arrow c with the rotation of the metallic fixing roller 4.

The reference numeral 12 designates a CPU as timing control means for effecting the control of the fixing apparatus, the reference numeral 13 denotes a driving power supply for supplying a high frequency current to the coil assembly 10 by a signal from the CPU 12, and the reference numeral 14 designates size detecting means for detecting the size of the recording material, and this size detecting means 14 is adapted to judge the size of the recording material, for example, by the combination of the imputted signals of the plurality of push switches of a user panel.

The reference numeral 15 denotes driving means for effecting the displacement control of a magnetic flux shield plate 8 as magnetic flux shield means by the signal from the CPU 12, i.e., magnetic flux shield driving means. The recording material 3 having the unfixed toner image 7 transferred thereto is conveyed from a direction indicated by arrow b in FIG. 1 and is fed into a pressure contact nip portion N for nipping the recording material 3.

The recording material 3 is conveyed through the pressure contact nip portion N while the heat of the heated metallic fixing roller 4 and pressure acting from the pressure roller 2 are applied thereto. Thereby, the unfixed toner image is secured onto the recording material, whereby a fixed toner image is formed thereon. The recording material 3 passed through the pressure contact nip portion N is separated from the metallic fixing roller 4 by a separation claw 16 having its tip end portion abutting against the surface of the metallic fixing roller 4 and is conveyed leftwardly as viewed in FIG. 1, and is conveyed and delivered onto a delivery tray by delivery rollers, not shown.

The metallic fixing roller 4 is a hollow metallic conductor and has an electrically conductive layer formed of an electrically conductive magnetic material such as iron, nickel or SUS430. The outer peripheral surface of the metallic fixing roller 4 is coated with fluorine resin or the like, whereby a heat-resistant releasing layer is formed thereon. The thickness of the metal layer of the metallic fixing roller 4 is 0.02 mm to 3.0 mm.

The coil assembly 10 for generating a high frequency magnetic field is disposed in the hollow portion of the metallic fixing roller 4, and induces an induction current (eddy current) in the metallic fixing roller to generate Joule heat. This coil assembly 10 is held with a predetermined gap between the metallic fixing roller 4 and an induction coil 6 by a stay 11. The stay 11 is fixed to the fixing unit frame, not shown, and is non-rotatable.

The coil assembly 10 has a core 9 (corresponding to a core material) formed of a magnetic material, a bobbin 17 formed with a hole for inserting the core 9 thereinto, and an induction coil 6 (corresponding to an induction heat source) formed by a copper wire wound around the bobbin 17 for inducing an induction current in the metallic fixing roller 4 and heating the roller.

The core 9 may preferably be formed of a material great in permeability and small in self-loss, such as ferrite, Permalloy, Sendust or amorphous silicon steel plate. The bobbin 17 functions as an insulating portion for insulating the core 9 and the induction coil 6. The coil assembly 10 is fixed to the stay 11 formed discretely from the bobbin 17 and is contained so as not to be exposed to the outside of the metallic fixing roller.

The stay 11, the separation claw 16 and the bobbin 17 are formed of heat-resistant and electrically insulative engineering plastic. The pressure roller 2 is comprised of an axial core 18 and a silicon rubber layer 19 which is a surface releasing heat-resisting rubber layer formed around the axial core 18.

A temperature sensor 20 for detecting the temperature of the metallic fixing roller 4 is provided on the outer periphery of the metallic fixing roller 4. This temperature sensor 20 is in pressure contact with the surface of the metallic fixing roller 4 so as to face the induction coil 6 with the metallic fixing roller 4 interposed therebetween, or is in contact with the inner surface of the metallic fixing roller 4 so as to face the induction coil 6. Also, the temperature sensor 20 is comprises, for example, of a thermistor and the temperature of the metallic fixing roller 4 is detected by this thermistor, and on the basis of this detection signal, the supply of electric power to the induction coil 6 is controlled so that the temperature of the metallic fixing roller 4 may become an optimum temperature.

Above the metallic fixing roller 4, a thermostat 21 is further provided as a safety mechanism during the abnormal rise of the temperature. This thermostat 21 is in contact with the surface of the metallic fixing roller 4, and when the metallic fixing roller 4 reaches a preset temperature, the contact of the thermostat is opened to cut off the supply of electric power to the induction coil 6, thereby preventing the metallic fixing roller 4 from assuming a temperature higher than a predetermined temperature.

Figure 4:
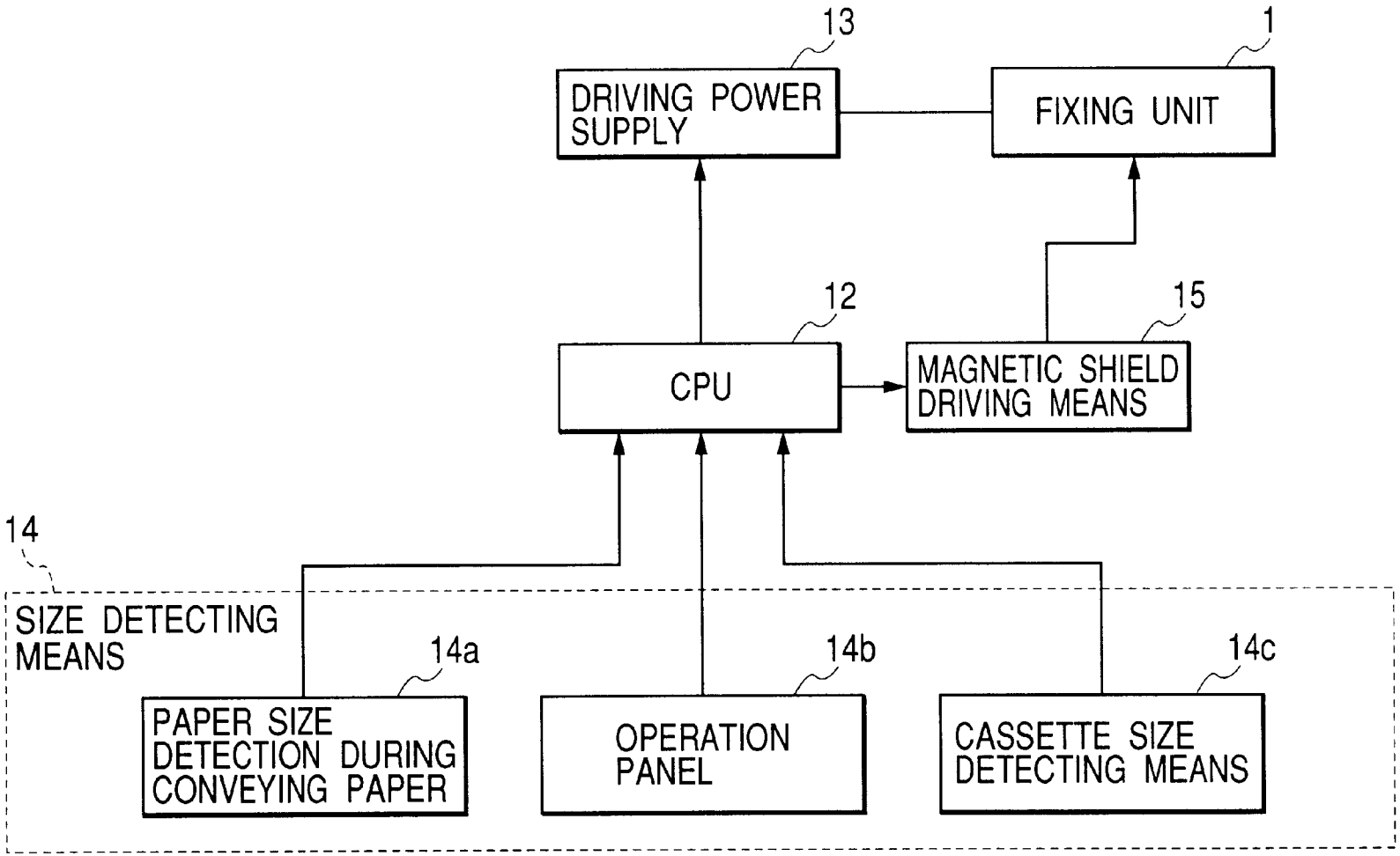
FIG. 4 shows the construction of recording material size detecting means.

FIG. 4 shows the construction of the size detecting means 14 which comprises size detecting means 14*a* during the conveyance of the recording material, an operation panel 14*b* and cassette size detecting means 14*c*, and each of the cassette size detecting means 14*c* and the size detecting means 14*a* during the conveyance is comprised of an ultrasonic sensor or the like. The construction uses a signal by the size of the recording material selected by a preset user operation panel, but in order to avoid the user's wrong operation and the wrong insertion into a recording material supply cassette, the recording material supply cassette and a construction adapted to be detected by a sensor placed in the conveying path during the conveyance of the recording material may be combined together for use.

Figure 6:
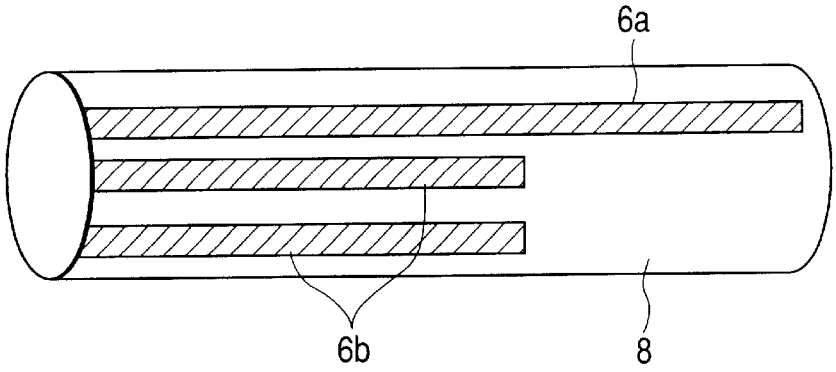
FIG. 6 shows the construction of the magnetic flux shield plate.

FIG. 6 shows another embodiment of the magnetic flux shield plate 8, and in this embodiment, non-magnetic material portions 6*a* and 6*b* of small specific resistance differing in length made into a stage-like shape or a band-like shape conforming to a size for covering the lower ferrite portion of the non-feeding region for paper are formed on an engineering plastic material.

In the embodiment, particularly between the metallic fixing roller 4 and the induction coil 6, the magnetic flux shield plate 8 (corresponding to magnetic flux adjusting means) for shielding a part of a magnetic flux reaching the metalling fixing roller 4 from the induction coil 6 is movably provided in such a manner as to be along the inner surface of the metallic fixing roller, and the position of the magnetic flux shield plate 8 is changed into the rotation direction of the metallic fixing roller 4 by magnetic flux shield driving means 15, whereby the heat generation range by an induction current can be controlled in operative association with the size detecting means 14. Also, the control of this heat generation range becomes more effective as the heating medium is thinner like the metallic fixing roller 4 and heat movement is more difficult in the longitudinal direction thereof.

The magnetic flux shield driving means 15 has a motor, not shown in FIG. 1, for rotatively driving the magnetic flux shield plate 8, and by the driving of this motor, the magnetic flux shield plate 8 can be rotated in the rotation direction of the metallic fixing roller 4. As the motor, use is made, for example, of a stepping motor or the like. The magnetic flux shield driving means 15 is not restricted to such a construction, but may use, for example, a belt instead of the motor, or can be designed to rotatively drive the magnetic flux shield plate by a screw.

As the material of the magnetic flux shield plate 8, copper, aluminum, silver or an alloy thereof which is an electrical conductor through which an induction current can flow and is a nonmagnetic material of small specific resistance, or ferrite of great specific resistance confining a magnetic flux therein or the like is suitable. This magnetic flux shield plate 8, as shown in FIG. 1, presents an arcuately curved surface covering chiefly the lower half of the ferrite of the induction coil 6, is made integral with the cylindrical shape of engineering plastic or the like, and is placed with a predetermined gap between the metallic fixing roller 4 and the coil assembly 10.

Figure 3A:
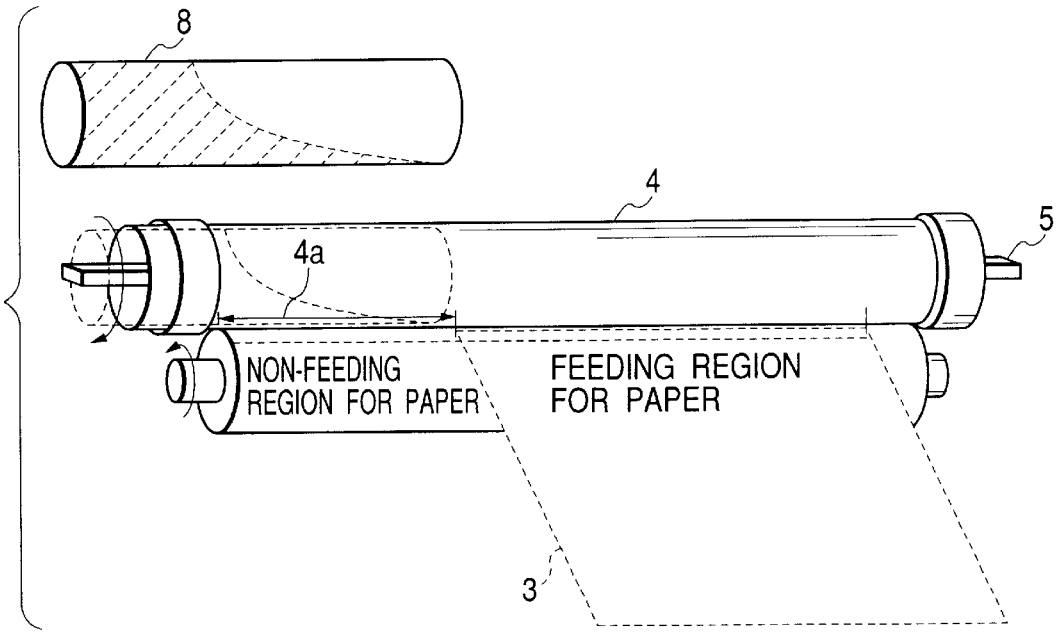
FIGS. 3A and 3B are perspective views showing the relation between a magnetic flux shield plate and the passing region of a recording material.

FIG. 3A shows the state when the toner is actually fixed on the recording material 3, and the metallic fixing roller 4 and the pressure roller 2 are rotated in the directions of arrows. When as shown, a recording material 3 of a small size (indicated by a dot-and-dash line in FIG. 3A) is fed, the magnetic flux shield plate 8 is rotatively moved on the inner surface of the metallic fixing roller 4 to a position (indicated by dots-and-dash line in FIG. 3A) covering the lower half of the ferrite at a distance 4*a* nearest to the metallic fixing roller 4 in the axial range corresponding to the non-feeding region for paper of the metallic fixing roller 4 by the magnetic flux shield driving means 15.

Figure 3B:
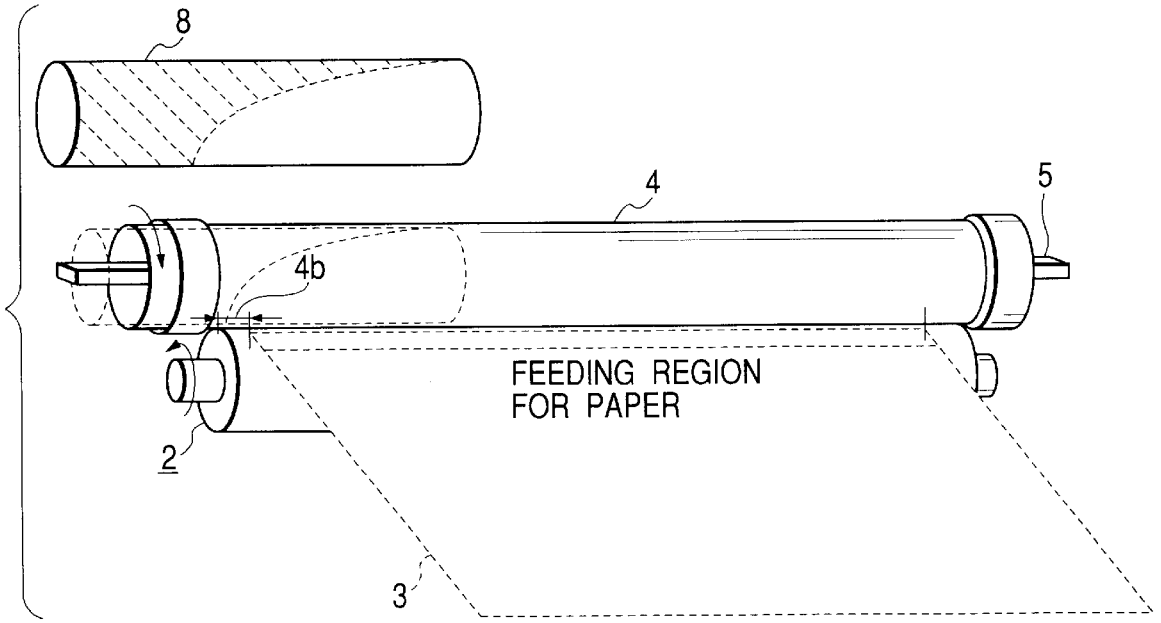

On the other hand, when as shown in FIG. 3B, a recording material of a large size is fed, the magnetic flux shield plate 8 is first rotatively moved to a position (indicated by dots-and-dash line in FIG. 3B) covering the lower half of the ferrite at a distance 4*b* nearest to the metallic fixing roller 4 in the axial range corresponding to the non-feeding region for paper of the metallic fixing roller 4.

Figure 5A:
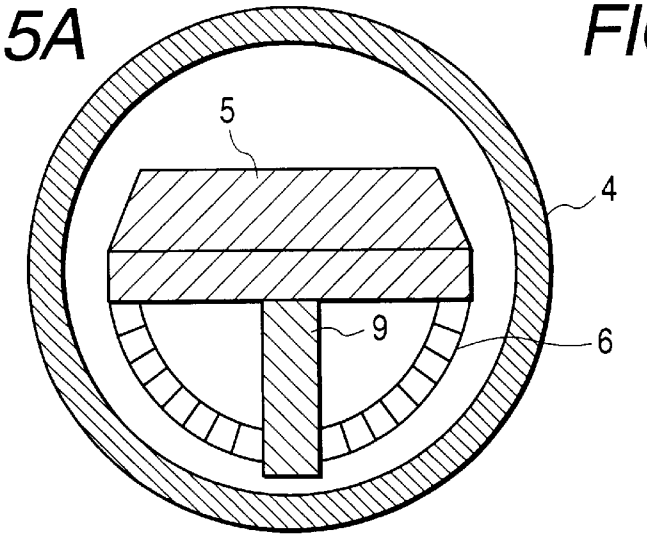
FIGS. 5A, 5B, 5C and 5D show the magnetic flux density of the vertical cross-section of the metallic roller.
Figure 5C:
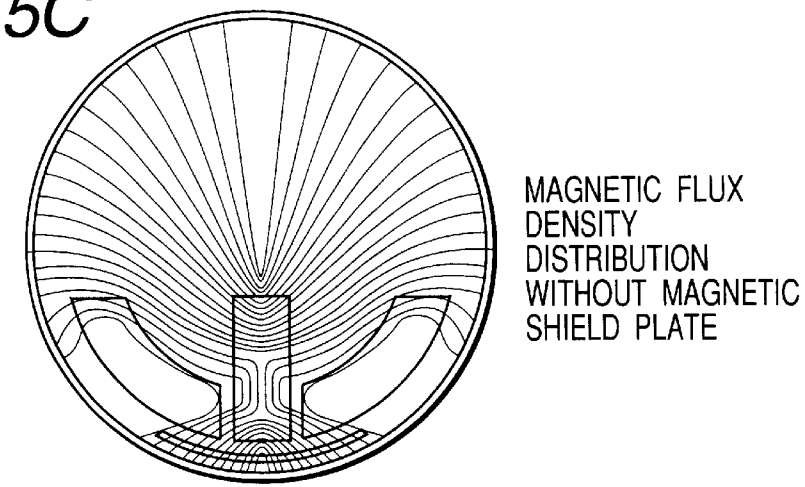
Figure 5B:
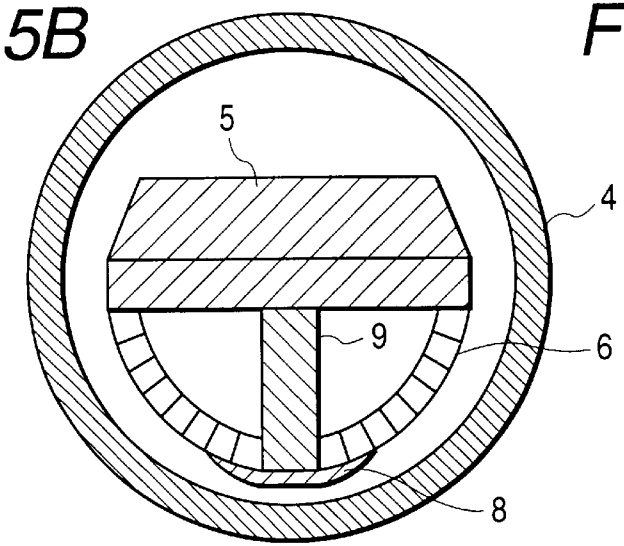
Figure 5D:
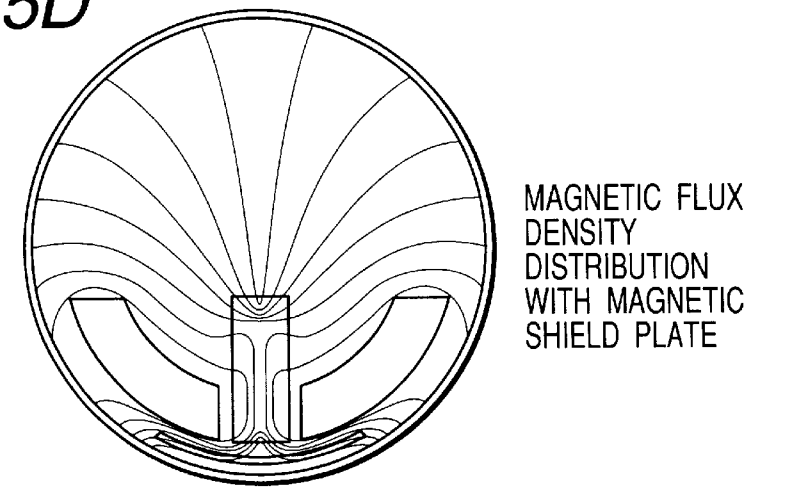

FIG. 5C shows the magnetic flux density distribution of the vertical cross-section of the metallic fixing roller 4 in the feeding region for paper when the magnetic flux shield plate 8 is absent as shown in FIG. 5A, and FIG. 5D shows the magnetic flux density distribution of the vertical cross-section of the metallic fixing roller 4 in the non-feeding region for paper when the magnetic flux shield plate 8 is present as shown in FIG. 5B.

Consequently, FIG. 5D represents the magnetic flux density distribution when the width of the lower half of the ferrite at the distance nearest to the metallic fixing roller 4 is covered, and it is clear that the magnetic flux density distribution is decreased relative to the state of FIG. 5C in which the magnetic flux shield plate 8 is absent, and any abnormal temperature rise is avoided. As described above, the magnetic flux shield plate 8 has its position changed by the magnetic flux shield driving means 15 in conformity with the feeding range on the metallic fixing roller 4 and can therefore cope with recording materials of various widths.

This feeding range is designed to obtain information by the size detecting means 14, but alternatively may be designed to detect information b y providing a plurality of means for detecting the temperatures of the metallic fixing roller 4, the pressure roller 2, etc. along the axial direction (neither of them is shown). The magnetic flux shield plate 8 is not limited to the cylindrical shape, but may also have an arcuately curved surface.

The recording material size detecting means outputs a signal by the size of a recording material selected by a preset user operation panel, not shown, but use may also be made of a construction in which in order to avoid the user's wrong operation and the wrong insertion of the size of the recording material into the recording material supply cassette, detection is effected by a sensor placed in the recording material supply cassette or the conveying path during the conveyance of the recording material.

The above-described embodiment has not been described to restrict the present invention, but various changes therein are possible. For example, while the above-described embodiment has been described with respect to a fixing apparatus using the hollow metallic fixing roller 4 as a heating medium, the present invention is not restricted thereto, but can of course also be applied to a fixing apparatus using a metallic sleeve.

The action of the embodiment will now be described.

Even in the case of a thin-walled metallic fixing roller 4, it becomes possible to control the heat distribution of the metallic fixing roller 4 rising in temperature, irrespective of the size of the recording material fed, and any other portion than the necessary portions is not caused to effect heat generation itself and therefore, heat loss is small, and this also leads to energy saving.

Accordingly, it becomes possible to reduce the temperature rise of the metallic fixing roller 4 in the non-feeding region for paper, and the uneven temperature of the metallic feeding roller 4 in the longitudinal direction thereof can be suppressed. Thereby, the occurrence of the high temperature offset due to partly uneven fixing property during the feeding of a recording material of a large size immediately after the feeding of the recording material 3 of a small size, the occurrence of wrinkles, skew feed or jam due to the uneven temperature during the feeding of a recording material of a large size also immediately after the feeding of a recording material 3 of a small size, the occurrence of internal thermal stress due to the temperature distribution difference in the metallic fixing roller 4 and the resultant deterioration of the roller, and such inconvenience by the temperature rise of the non-feeding region of the metallic fixing roller 4 as the fusion deformation or damage of the constituent parts of the fixing apparatus due to their temperature exceeding a heat-resisting temperature can be efficiently prevented.

Consequently, in the fixing apparatus, the temperature rise of the outer peripheral surface of the metallic fixing roller in the non-feeding region for paper thereof is suppressed, whereby it is possible to suppress the temperature rise due to the heat generation of the excitation coil itself as magnetic field generating means, and the rise of energy efficiency and the use of an insulative bundle wire of a low grade as the conductor of the coil are made possible.

Second Embodiment

Figure 7:
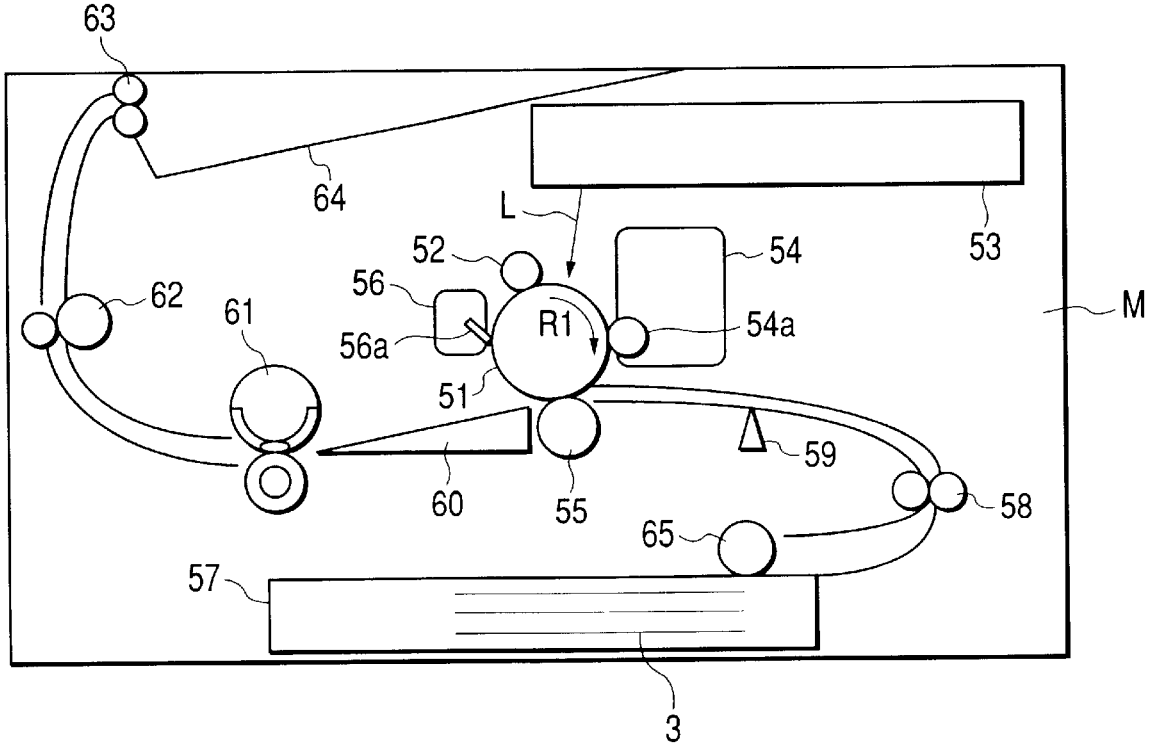
FIG. 7 shows the construction of an image forming apparatus.

FIG. 7 shows an image forming apparatus provided with a heating apparatus according to the present invention as a fixing apparatus, and is a longitudinal cross-sectional view schematically showing the construction of a laser beam printer as an example of the image forming apparatus.

The construction of the image forming apparatus will first be described with reference to FIG. 7. A drum-shaped electrophotographic photosensitive body (hereinafter referred to as the "photosensitive drum") 51 as an image bearing body is rotatably supported on the main body M of the apparatus, and is rotatively driven at a predetermined process speed in the direction of arrow R1 by driving means (not shown). Around this photosensitive drum 51, along the rotation direction thereof, there are successively disposed a charging roller (charging apparatus) 52, exposure means 53, a developing apparatus 54, a transfer roller (transfer apparatus) 55 and a cleaning apparatus 56.

Also, a recording material cassette 57 containing sheet-shaped recording materials 3 therein is disposed in the lower portion of the main body M of the apparatus, and from the upstream side along the conveyance path of the recording materials 3, there are successively disposed a recording material feeding roller 65, conveying rollers 58, a top sensor 59, a conveying guide 60, a fixing apparatus 61 to which a heating apparatus according to the present invention is applied, conveying rollers 62, recording material delivery rollers 63 and a recording material delivery tray 64.

The operation of the image forming apparatus of the above-described construction will now be described.

The photosensitive drum 51 rotatively driven in the direction of arrow R1 by the driving means (not shown) is uniformly charged to a predetermined polarity and predetermined potential by the charging roller 52. An image exposing operation based on image information is performed on the surface of the photosensitive drum 51 after-charged by exposure means 53 such as a laser optical system, and the charges of the exposed portion are eliminated and an electrostatic latent image is formed.

This electrostatic latent image is developed by the developing apparatus 54. The developing apparatus 54 has a developing roller 54*a*, and a developing bias is applied to this developing roller 54*a* and a toner is made to electrostatically adhere to the electrostatic latent image on the photosensitive drum 51 to thereby effect the development (visualization) of the latent image as an unfixed toner image. This unfixed toner image is transferred to the recording material 3 by the transfer roller 55.

The recording material 3 is contained in a recording material cassette 57, and is fed and conveyed by the recording material feeding roller 65 and the conveying rollers 58, and is conveyed to the transfer nip portion between the photosensitive drum 51 and the transfer roller 55 through the top sensor 59. At this time, the recording material 3 has its leading end detected by the top sensor 59, and is timed with the unfixed toner image on the photosensitive drum 51.

A transfer bias is applied to the transfer roller 55, whereby the unfixed toner image on the photosensitive drum 51 is transferred to a predetermined position on the recording material 3. The recording material 3 now bearing the unfixed toner image on its surface by the transfer is conveyed along the conveying guide 60 to the fixing apparatus 61, where the unfixed toner image is heated and pressurized and is fixed on the surface of the recording material 3. The fixing apparatus 61 will be described later in detail.

The recording material 3 after the unfixed toner image has been fixed thereon is conveyed and delivered onto the recording material delivery tray 64 on the main body M of the apparatus by the conveying rollers 62 and the recording material delivery rollers 63. On the other hand, as regards the photosensitive drum 51 from which the unfixed toner image has been transferred, any unfixed toner not transferred to the recording material 3 but residual on the surface of the photosensitive drum 51 (untransferred toner) is removed by the cleaning blade 56*a* of the cleaning apparatus 56, and the photosensitive drum 51 prepares for the next image formation. By the above-described operation being repeated, image formation can be effected one after another.

The present invention is not restricted to the above-described embodiments, but covers modifications similar in technical idea thereto.

What is claimed is:

1. An image heating apparatus for heating an image formed on a recording material, comprising:

a heating member;

an excitation coil for generating a magnetic flux to induce an eddy current in said heating member; and a magnetic flux shield member coupled to said heating member for making the magnetic flux small;

wherein a magnetic flux shield width of said magnetic flux shield member in a longitudinal direction of said heating member differs in a direction intersecting with the longitudinal direction, and said magnetic flux shield member is movable in the direction intersecting with the longitudinal direction.

2. An image heating apparatus according to claim 1, further comprising driving means for driving said magnetic flux shield member, and wherein said driving means moves said magnetic flux shield member in conformity with the size information of the recording material.

3. An image heating apparatus according to claim 1, wherein the magnetic flux shield width of said magnetic flux shield member in the longitudinal direction of said heating member differs gently in the direction intersecting with the longitudinal direction.

4. An image heating apparatus according to claim 1, wherein said heating member is cylindrically shaped, and said magnetic flux shield member has a shape along the shape of said heating member.

5. An image heating apparatus according to claim 1, wherein said magnetic flux shield member is disposed in an area corresponding to the longitudinal end portion of said heating member.

6. An image heating apparatus according to claim 1, wherein said magnetic flux shield member is formed of a nonmagnetic material.

7. An image heating apparatus according to claim 6, wherein said nonmagnetic material is copper, aluminum, silver or an alloy thereof.

8. An image heating apparatus according to claim 6, wherein said nonmagnetic material is ferrite.

* * * * *

UNITED STATES PATENT AND TRADEMARK OFFICE

CERTIFICATE OF CORRECTION

PATENT NO. : 6,453,144 B1
DATED : September 17, 2002
INVENTOR(S) : Takashi Sato

It is certified that error appears in the above-identified patent and that said Letters Patent is hereby corrected as shown below:

Column 1,
Line 28, “heated.,” should read -- heated, --.
Line 45, “portion.(non-feeding” should read -- portion (non-feeding --.

Column 2,
Line 28, “of.” should read -- of --.
Line 34, “small;” should read -- small, --.

Column 4,
Line 34, “comprises,” should read -- comprised, --.
Line 39, “optimum” should read -- optimal --.

Column 6,
Line 15, “b y” should read -- by --.

Column 8,
Line 47, “gently” should read -- slightly --.

Signed and Sealed this

Eleventh Day of February, 2003

JAMES E. ROGAN
*Director of the United States Patent and Trademark Office*